US007914341B2

(12) United States Patent
Chung et al.

(10) Patent No.: US 7,914,341 B2
(45) **Date of Patent: *Mar. 29, 2011**

(54) AUDIO SIGNAL SWITCHER

(75) Inventors: Shin-Hong Chung, Taipei Hsien (TW); Xiao-Guang Li, Shenzhen (TW); Kuan-Hong Hsieh, Taipei Hsien (TW)

(73) Assignees: Ensky Technology (Shenzhen) Co., Ltd., Shenzhen, Guangdong Province (CN); Ensky Technology Co., Ltd., Pan Chiao, Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/790,888

(22) Filed: May 31, 2010

(65) Prior Publication Data

US 2010/0240264 A1 Sep. 23, 2010

Related U.S. Application Data

(62) Division of application No. 11/964,049, filed on Dec. 26, 2007, now Pat. No. 7,744,428.

(30) Foreign Application Priority Data

Jan. 5, 2007 (CN) ..... 2007 1 0200010

(51) Int. Cl.
*H01R 24/04* (2006.01)

(52) U.S. Cl. ..... 439/668

(58) Field of Classification Search ..... 439/668, 439/669, 654, 676, 188, 638, 218, 606, 502
See application file for complete search history.

(56) References Cited

U.S. PATENT DOCUMENTS

| | | | | |
|---|---|---|---|---|
| 6,203,344 | B1 * | 3/2001 | Ito | 439/218 |
| 6,616,487 | B1 * | 9/2003 | Lai | 439/668 |
| 7,354,315 | B2 * | 4/2008 | Goetz et al. | 439/669 |
| 7,744,428 | B2 * | 6/2010 | Chung et al. | 439/668 |
| 2007/0047745 | A1 * | 3/2007 | Lai et al. | 381/123 |

FOREIGN PATENT DOCUMENTS

| | | |
|---|---|---|
| CN | 2716898 Y | 8/2005 |
| CN | 1832631 A | 9/2006 |

* cited by examiner

*Primary Examiner* — Edwin A. Leon
(74) *Attorney, Agent, or Firm* — Zhigang Ma

(57) ABSTRACT

An audio signal switcher includes a jack switcher and a plug switcher. The jack switcher includes an audio jack and a first USB port. The audio jack includes a left track segment and a right track segment which are coupled to a first data pin and a second data pin of the first USB port, respectively. The jack includes a ground segment divided into a left ground ring and a right ground ring which are connected together to couple to a ground pin of the USB port. The plug switcher includes an audio plug and a second USB port. The second USB port also includes a data pin, a second data pin, a power pin, and a ground pin. The audio plug also includes a left track segment, a right track segment, and a ground segment, which are isolated coupled to at least three pins of the second USB port.

6 Claims, 9 Drawing Sheets

AUDIO SIGNAL SWITCHER

This is a divisional application of U.S. Ser. No. 11/964,049, entitled audio signal switcher, filed on Dec. 26, 2007, now U.S. Pat. No. 7,744,428.

BACKGROUND

1. Technical Field

The present disclosure relates to an audio signal switcher, particularly to an audio signal switcher with a USB cable.

2. Related Art

Nowadays, it is common for electronic devices with an audio playing function to be configured with an earphone input connector. It is also common for electronic devices with a storage function to be configured with a USB interface. Thus, if an electronic device includes both an audio playing function and a USB interface, the user of the electronic device may have to carry earphones and USB cables. Both of these cables must be long enough to facilitate users sizes and desires. However, if the length of the cables is too long, the cables may become somewhat cumbersome and tend to tangle. Furthermore, it is troublesome for a user to carry many long cables.

Accordingly, it would be advantageous if the electronic device uses shorter cables with multiple uses. A USB cable can be used to transmit data between the electronic device and the storage device, and can also be used as an extension to the earphone cable. Thus the earphones and USB cables can be shorter. Shorter cables facilitate ease of use, a neat appearance when packaged, and easy carrying.

SUMMARY

An audio signal switcher includes a jack switcher and a plug switcher. The jack switcher includes an audio jack and a first USB port. The first USB port includes a first data pin, a second data pin, a power pin, and a ground pin. The audio jack includes a left track segment, a right track segment, and a ground segment, which are electrically isolated coupled to at least three pins of the first USB port. The plug switcher includes an audio plug and a second USB port. The second USB port also includes a data pin, a second data pin, a power pin, and a ground pin. The audio plug also includes a left track segment, a right track segment, and a ground segment, which are electrically isolated coupled to at least three pins of the second USB port according to a connection between the audio jack and the first USB port. The plug switcher can be connected to the jack switcher by a USB cable.

BRIEF DESCRIPTION OF THE DRAWINGS

The components of the drawings are not necessarily drawn to measuring scale, the emphasis instead being placed upon clearly illustrating the principles of the audio signal switcher. Moreover, in the drawings, like reference numerals designate corresponding parts throughout the several views.

DETAILED DESCRIPTION OF THE EMBODIMENTS

Figure 1:
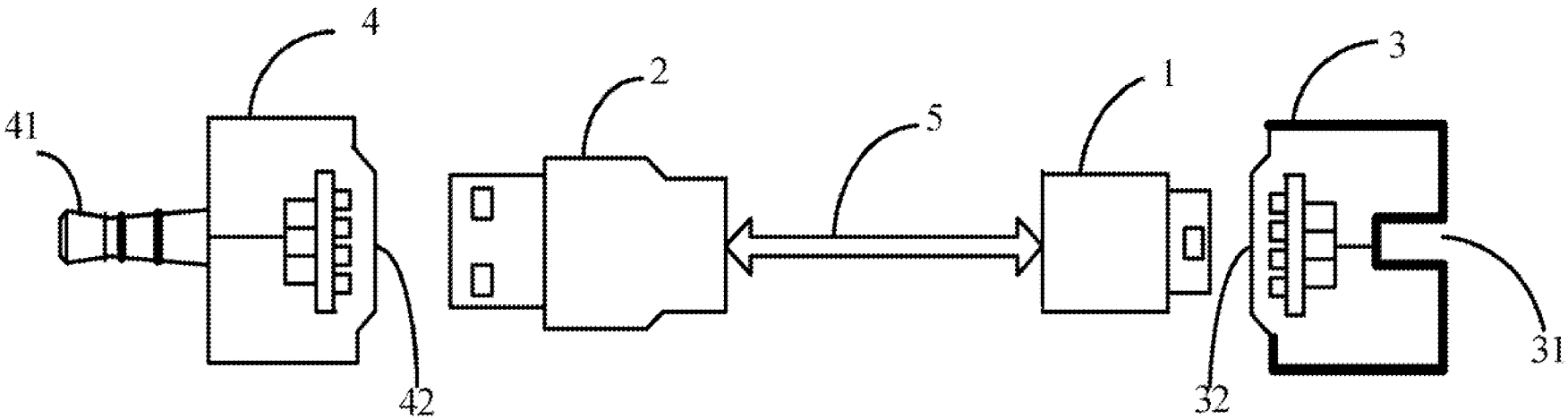
FIG. 1 shows a schematic diagram of an audio signal switcher according to a first embodiment, the audio signal switcher being connected with a USB cable.

FIG. 1 shows a schematic diagram of an audio signal switcher with a USB cable according to a first embodiment. The audio signal switcher includes a jack switcher 3 and a plug switcher 4 provided for connecting USB connectors at respective end of a USB cable 5. The USB connectors at respective end of the USB cable 5 are referred to as a first USB connector 1 and a second USB connector 2.

The jack switcher 3 includes an audio jack 31 and a first USB port 32. The audio jack 31 is a standard 3.5 mm audio jack, which is used for connecting with audio output devices such as an earphone. An inner structure of the jack switcher 3 will be described below with reference to FIG. 2.

The plug switcher 4 includes an audio plug 41 and a second USB port 42. The audio plug 41 is a standard 3.5 mm audio plug, which is used for connecting with an audio jack of an MP3 player, a computer or any other electronic device. An inner structure of the plug switcher 4 will be described below with reference to FIG. 3.

Figure 2:
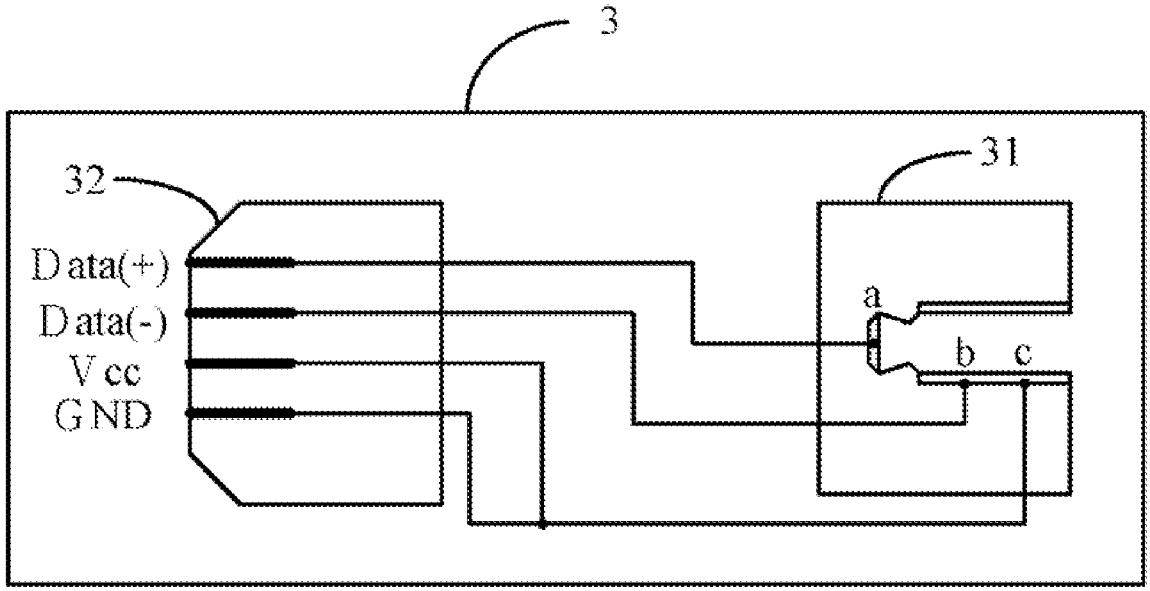
FIG. 2 is an inner electrical connection diagram of a jack switcher of the audio signal switcher of FIG. 1.
Figure 4:
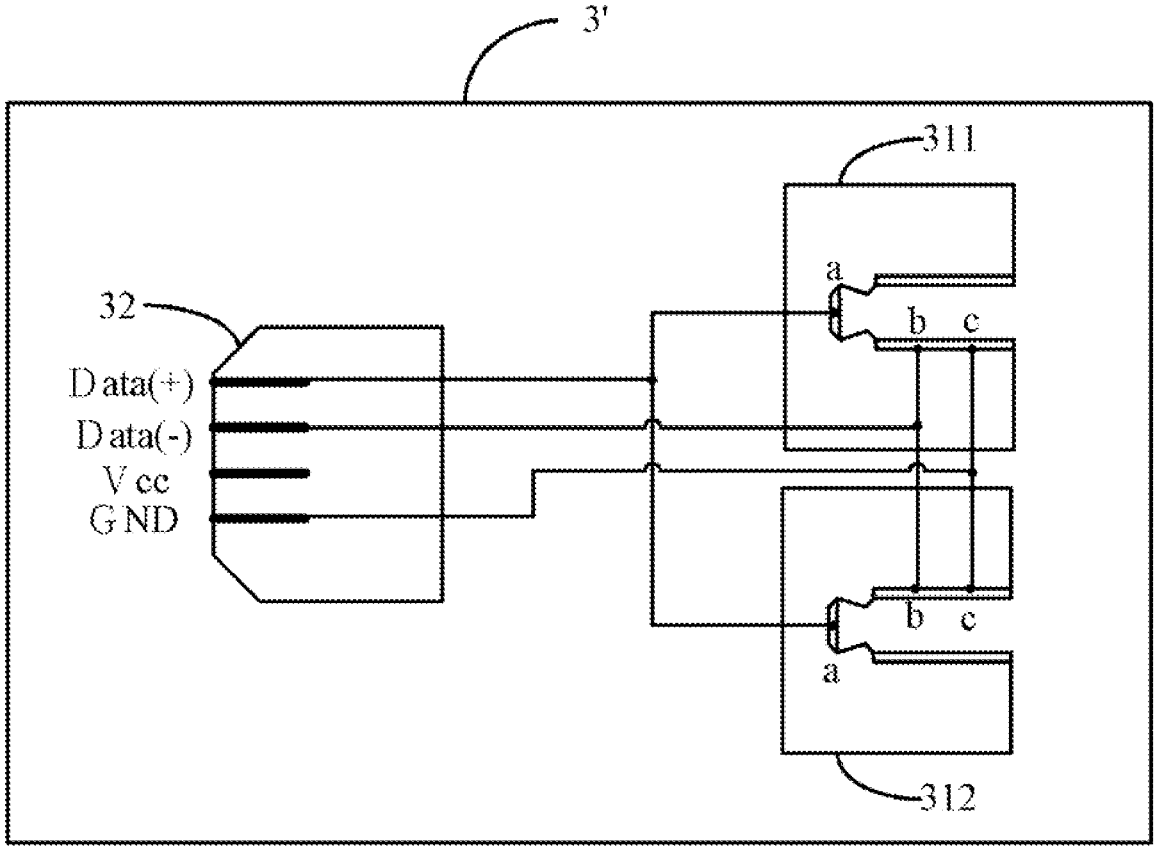
FIG. 4 is a schematic diagram of a jack switcher according to a second embodiment.

FIG. 2 is an inner electrical connection diagram of the jack switcher 3. The audio jack 31 is used for receiving a standard audio plug and includes three electrical parts: a left track segment "a", a right track segment "b", and a ground segment "c", each of which is electrically isolated from others. The first USB port 32 including a first data pin (Data+), a second data pin (Data−), a power pin (VCC), and a ground pin (GND). The left track segment "a", the right track segment "b", and the ground segment "c" are coupled to at least three pins of the first USB port 32. In FIG. 2, the left track segment "a" and the right track segment "b" are coupled to the first data pin (Data+) and the second data pin (Data−), respectively. The ground segment "c" is coupled to the power pin (VCC) and the ground pin (GND) of the first USB port 32. The ground segment "c" also can be electrically isolated coupled to the power pin (VCC) or the ground pin (GND) of the first USB port 32. (as shown in FIG. 4)

Figure 3:
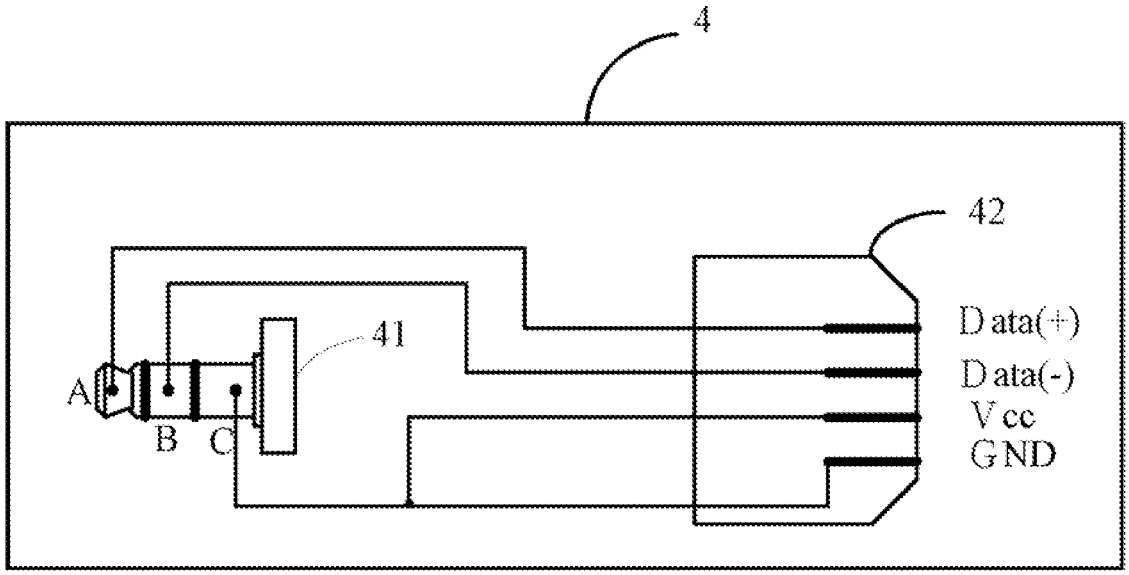
FIG. 3 is an inner electrical connection diagram of a plug switcher of the audio signal switcher of FIG. 1.

FIG. 3 is an inner electrical connection diagram of the plug switcher 4. The audio plug 41 includes three electrical parts: a left track segment "A", a right track input segment "B" and a ground segment "C", each of which is electrically isolated from the others. The second USB port 42 includes a first data pin (Data+), a second data pin (Data−), a power pin (VCC), and a ground pin (GND). The left track segment "A", the right track segment "B", and the ground segment "C" are electrically isolated coupled to at least three pins of the second USB port 42. In FIG. 3, the left track segment "A" and the right track segment "B" are coupled to the first data pin (Data+) and the second data pin (Data−) of the second USB port 42. The ground segment "C" is coupled to the power pin (VCC) and the ground pin (GND) of the second USB port 42.

The electrical connections inside of the jack switcher 3 and the plug switcher 4 are not limited to the means introduced in FIG. 2 and FIG. 3. For example, alternatively, the left track segment "a" of the audio jack 42 can be connected to the second data pin (Data−) of the of the USB port 32, and the right track segment "b" can be connected to the first data pin (Data−) of the first USB port 32. Correspondingly, the left track segment "A" of the audio plug 41 can be connected to the second data pin (Data−) of the second USB port 42, and the right track segment "B" can be connected to the first data pin (Data+) of the second USB port 42. In addition, any one pin of the first USB port 32 can be idle without connecting with any segment of the audio jack 31 while the other three pins of the USB port 32 are correspondingly coupled to the left track segment "a", the right track segment "b" and the ground segment "c" of the audio jack 31. Correspondingly, the pin of second USB port 32 respecting to the idle pin of the first USB port 32 should be idle, and the other pins are correspondingly coupled to the left track segment "A", the right track segment "B" and the ground segment "C" of the audio plug 41.

Three applications of the audio signal switcher are described below.

In the first application, the audio plug 41 of the plug switcher 4 is inserted into the audio jack of an MP3 or another electronic device. The second USB port 42 is a standard female connector and the second connector 2 is a standard male connector. The second USB port 42 is coupled to the second connector 2. The first USB port 32 is a standard male connector and the first connector 1 is a standard female connector. The first USB port 32 is coupled to the first connector 1. The audio jack 31 receives an audio plug of an audio output device such as an earphone. The audio signal from the MP3 or other electronic device is transmitted via the audio plug 41, the second USB port 42, the USB cable 5, the first USB port 32, and the second audio jack 31 before being outputted by the audio output device.

In the second application, the second USB port 42 is a standard male connector and the second connector 2 is a standard female connector. The first USB port 32 is a standard female connector and the first connector 1 is a standard male connector.

In the third application the MP3 or another electronic device is assumed to include a USB port. The second USB connector 2 is directly coupled with the USB port of the MP3 or other electronic devices, and the first USB connector 1 is coupled with the first USB port 32. The audio signal outputted by the MP3 or other electronic devices is transmitted via the USB cable 5 and the second connector 2 to the audio output device.

FIG. 4 shows a schematic diagram of a jack switcher of a second embodiment. In the second embodiment, a jack switcher 3' including two parallel audio jacks 311 and 312 is introduced. The two audio jacks 311' and 312' are both connected to a first USB port 32' and are provided for receiving two audio plugs of audio output devices, so that the audio signals from the MP3 or another electronic device can be outputted by the audio output device simultaneously. Similarly, in other cases, the jack switcher 3' can also be configured with more than two parallel audio jacks, such that the audio signals can be outputted by more than two audio output devices simultaneously.

Figure 5:
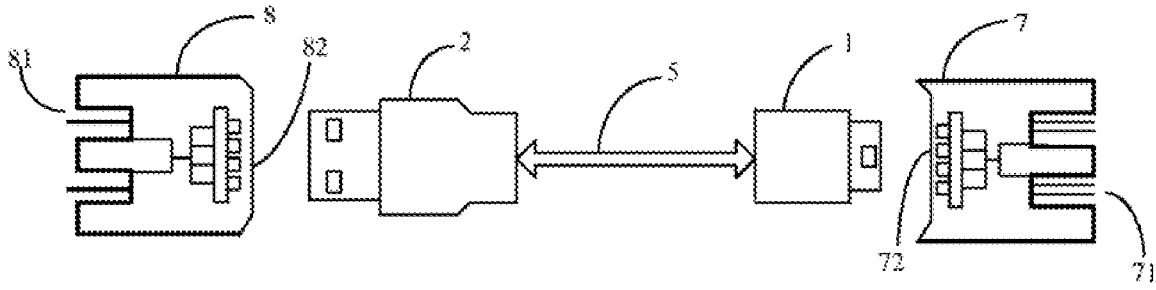
FIG. 5 shows a schematic diagram of an audio signal switcher according to a third embodiment, the audio signal switcher being connected with a USB cable.

FIG. 5 shows a schematic diagram of an audio signal switcher with a USB cable according to a third embodiment. Similar to the first embodiment, the audio signal switcher includes a jack switcher 7 and a plug switcher 8 provided for connecting USB connectors at respective end of a USB cable 5. The jack switcher 7 includes an audio jack 71 and a first USB port 72. The plug switcher 8 includes an audio plug 81 and a second USB port 82.

Figure 6:
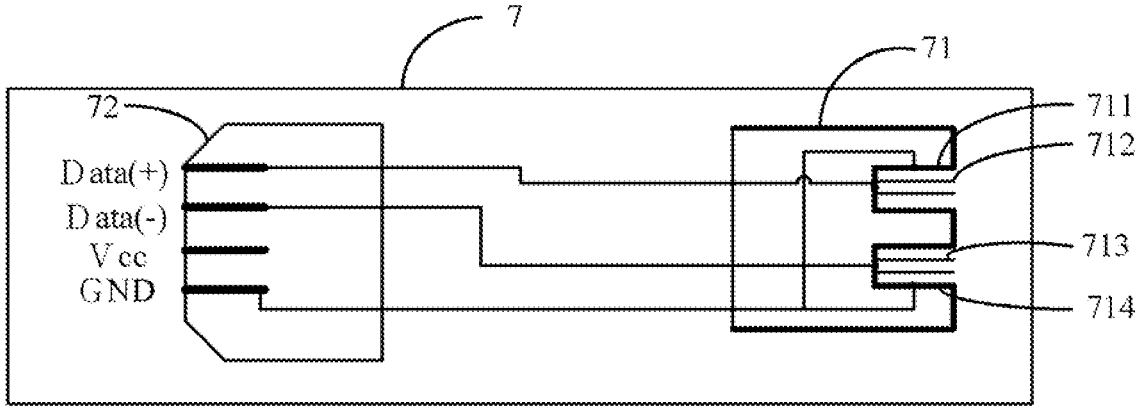
FIG. 6 is an inner electrical connection diagram of a jack switcher of the audio signal switcher of FIG. 5.

FIG. 6 shows an inner electrical connection diagram of the jack switcher 7 according to the third embodiment. In this embodiment, the audio jack 71 is a standard RCA socket. Correspondingly, the left track segment is a left port 712, the right track segment is a right port 713, the ground segment is divided into a left ground ring 711 and a right ground ring 714, the left ground ring 711 is around the left port 712, and the right ground ring 714 is around the right port 713. The left ground ring 711 and the right ground ring 714 are connected together to couple to a ground pin (GND) of the first USB port 72.

Figure 7:
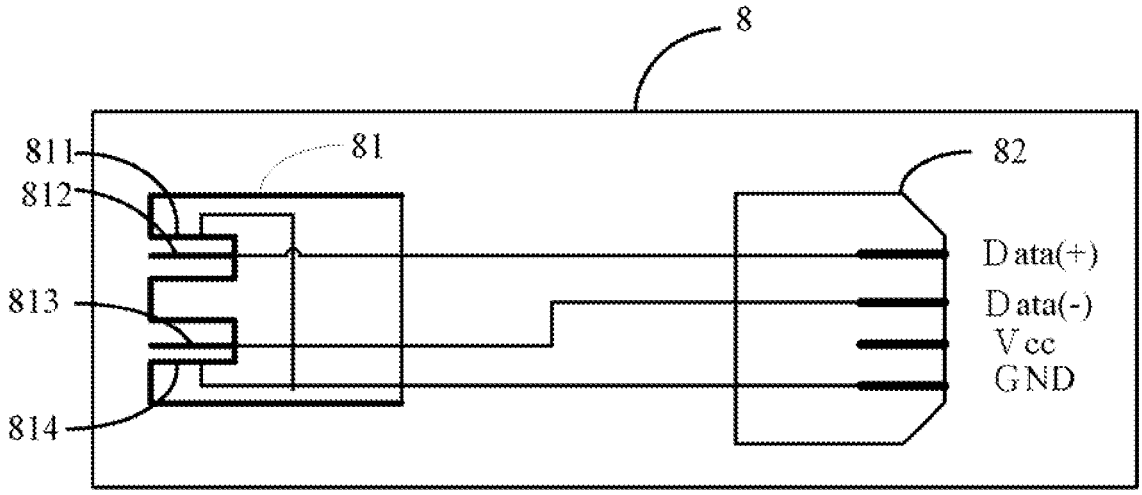
FIG. 7 is an inner electrical connection diagram of a jack switcher of the audio signal switcher of FIG. 5.

FIG. 7 shows an inner electrical connection diagram of the plug switcher 8 according to the third embodiment. In this embodiment, the audio plug 81 is a standard RCA plug. Correspondingly, the left track segment is a left pin 812, the right track segment is a right pin 813, the ground segment is divided into a left ground ring 811 and a right ground ring 814, the left ground ring 811 is around the left pin 812, and the right ground ring 814 is around the right pin 813. The left ground ring 811 and the right ground ring 814 are connected together to couple to a ground pin (GND) of the second USB port 72.

As shown in the FIG. 5, similar to the first application introduced above, the audio signal outputted from a RCA jack of the electronic device is transmitted via the plug switcher 8, the USB cable 5, and the jack switcher 7 in turn before outputted by the audio output device.

Figure 8:
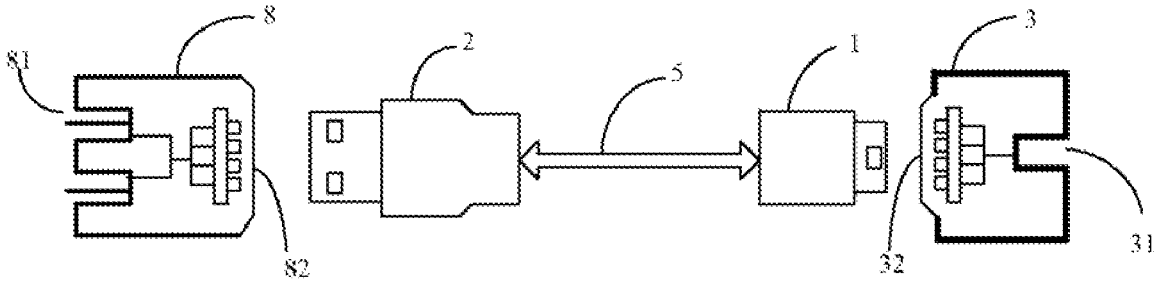
FIG. 8 shows a schematic diagram of an audio signal switcher according to a fourth embodiment, the audio signal switcher being connected with a USB cable.

FIG. 8 shows a schematic diagram of an audio signal switcher with a USB cable according to a fourth embodiment. The audio signal switcher includes the jack switcher 3 and the plug switcher 8. An earphone with a standard 3.5 mm audio plug can receive the audio signal outputted by an RCA jack of the electronic device.

Figure 9:
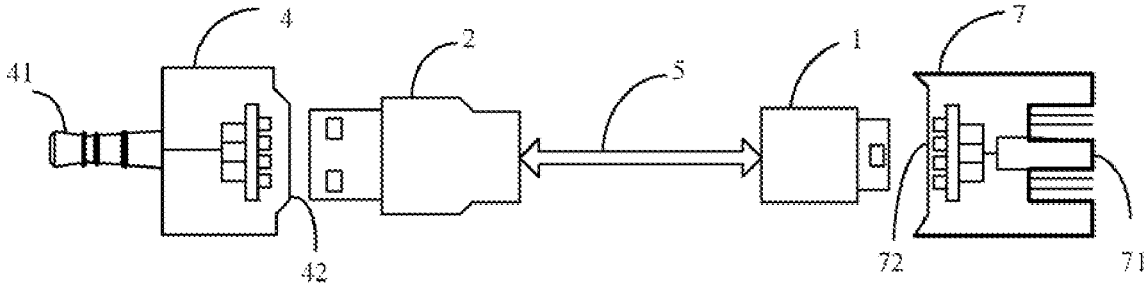
FIG. 9 shows a schematic diagram of an audio signal switcher according to a fifth embodiment, the audio signal switcher being connected with a USB cable.

FIG. 9 shows a schematic diagram of an audio signal switcher with a USB cable according to a fifth embodiment. The audio signal switcher includes the plug switcher 4 and the jack switcher 7. So, the audio signal outputted by a standard 3.5 mm audio jack of the electronic device can be received by a stereo video with an RCA plug.

In addition, as shown in the FIG. 6, if an electronic device is assumed to include a USB port to output audio signals, the first USB port 72 can be coupled to the USB port of the electronic device, and the audio signals can be received by an RCA plug from the audio plug 81.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An audio signal switcher comprising:

a jack switcher comprising an audio jack and a first USB port; the first USB port comprising a first data pin, a second data pin, and a ground pin, the audio jack comprising a left track segment, a right track segment, and a ground segment, the left track segment being a left port, the right track segment being a right port, the ground segment being divided into a left ground ring and a right ground ring, the left ground ring being around the left port, and the right ground being around the right port, the left port being coupled to the first data pin, the right port being coupled to the second data pin, and the left ground ring and the right ground being connected together to couple to the ground pin; and a plug switcher comprising an audio plug and a second USB port the second USB port comprising a first data pin, a second data pin, a power pin, and a ground pin; the audio plug comprising a left track segment, a right track segment, and a ground segment, the left track segment of the audio plug being coupled to the first data pin of the second USB port, the second track segment of the audio plug being coupled to the second data pin of the second USB port, and the ground segment being coupled to the power pin and the ground pin of the second USB port; the plug switcher being connected to the jack switcher by a USB cable.

2. The audio signal switcher according to claim 1, wherein the first USB port is a standard male connector for coupling to a first connector of a USB cable; the first connector is a standard female connector for coupling to the first USB port.

3. The audio signal switcher according to claim 1, wherein the first USB port is a standard female connector for coupling to a first connector of a USB cable; the first connector is a standard male connector for coupling to the first USB port.

4. The audio signal switcher according to claim 1, wherein the second USB port is a standard male connector for coupling to a second connector of a USB cable; the second connector is a standard female connector for coupling to the second USB port.

5. The audio signal switcher according to claim 1, wherein the second USB port is a standard female connector for coupling to a second connector of a USB cable; the second USB port is a standard male connector for coupling to a second connector of a USB cable.

6. The audio signal switcher according to claim 1, wherein the audio plug is a standard 3.5 mm audio plug.

* * * * *